United States Patent [19]

Aoki

[11] Patent Number: 4,962,292

[45] Date of Patent: Oct. 9, 1990

[54] HIGH-FREQUENCY HEATING APPARATUS HAVING DIGITAL CONTROLLED INVERTER

[75] Inventor: Masayuki Aoki, Ichinomiya, Japan

[73] Assignee: Kabushiki Kaisha Toshiba, Kawasaki, Japan

[21] Appl. No.: 369,706

[22] Filed: Jun. 22, 1989

[30] Foreign Application Priority Data

Jun. 27, 1988 [JP] Japan ..... 63-158705

[51] Int. Cl.[5] ..... H05B 6/68

[52] U.S. Cl. ..... 219/10.55 B; 219/10.77; 363/97; 323/902

[58] Field of Search ..... 219/10.55 B, 10.55 R, 219/10.77; 363/21, 97; 323/902

[56] References Cited

U.S. PATENT DOCUMENTS

| | | | |
|---|---|---|---|
| 3,940,684 | 2/1976 | Heinzman et al. | 323/902 X |
| 3,973,165 | 8/1976 | Hester | 219/10.55 B |
| 4,074,101 | 2/1978 | Kiuchi et al. | 219/10.77 |
| 4,092,510 | 5/1978 | Kiuchi et al. | 219/10.77 |
| 4,229,688 | 10/1980 | Knox et al. | 323/902 X |
| 4,383,157 | 5/1983 | Nakata et al. | 219/10.55 B |
| 4,680,506 | 7/1987 | Nilssen | 219/10.55 B |
| 4,757,176 | 7/1988 | Suzuki et al. | 219/10.77 |
| 4,825,028 | 4/1989 | Smith | 219/10.55 B |
| 4,833,581 | 5/1989 | Ishiyama | 219/10.55 B |

FOREIGN PATENT DOCUMENTS

| | | |
|---|---|---|
| 51-48285 | 12/1976 | Japan . |
| 2149242 | 6/1985 | United Kingdom . |
| 2187904 | 9/1987 | United Kingdom . |

*Primary Examiner*—Philip H. Leung

*Attorney, Agent, or Firm*—Cushman, Darby & Cushman

[57] ABSTRACT

A high-frequency heat source supplies a predetermined high-frequency heat output. An inverter circuit receives an AC input and supplies a high-frequency output to drive the high-frequency heat source. The inverter circuit includes a circuit for rectifying the AC input, and a switching element for switching a DC output from the rectification circuit. A timing circuit is coupled to the inverter circuit to detect a switching timing of the switching element to the inverter circuit. A controller outputs an ON/Off signal having a predetermined duty ratio corresponding to a heating output set value associated with the predetermined high-frequency heating output. The ON/Off signal is output at a predetermined timing in response to a detection output from the timing circuit. A drive circuit drives the switching element in the inverter circuit in response to the ON/Off signal output from the controller. A first isolation circuit electrically isolates the timing circuit from the controller. A second isolating circuit electrically isolates the controller from the drive circuit.

17 Claims, 4 Drawing Sheets

HIGH-FREQUENCY HEATING APPARATUS HAVING DIGITAL CONTROLLED INVERTER

BACKGROUND OF THE INVENTION

1. Field of the Invention

This invention generally relates to a high-frequency heating apparatus and, more particularly, to a high-frequency apparatus suitable for a cooking apparatus such as a microwave oven, an induction heating cooker, or their composite cooker.

2. Description of the Related Art

In general, as a cooker utilizing high-frequency heating, a microwave oven, an induction heating cooker, and a composite cooker having functions of these microwave oven and induction heating cooker are used. Such a high-frequency cooker includes an independent or common inverter circuit to supply a drive power to a heating operation section.

More specifically, by employing the inverter circuit in such a high-frequency heating (cooking) apparatus, a heating output can be continuously controlled, and a high-frequency power allows use of a light and small-sized high-voltage transformer in a heating operation section (in particular, in a microwave oven).

The high-frequency heating apparatus employing an inverter circuit has some problems to be solved.

One problem is that a main controller for controlling the entire apparatus and an inverter controller for controlling the inverter circuit in response to a command from the main controller are required. A switching timing detector for detecting an effective switching timing of switching elements in the inverter circuit is also required. In addition, an oscillation circuit for outputting a sawtooth signal, a pulse modulation circuit for modulating the pulse width of an output from the oscillation circuit in response to an output set signal, and the like are required when the inverter controller is of analog type, thus causing a complicated arrangement and high cost.

Another problem of this apparatus is that a countermeasure against a high-voltage fault from the inverter circuit must be taken to effectively protect the main and inverter controllers.

In a conventional high-frequency heating apparatus employing the inverter circuit, however, the above problems have not been effectively solved. For this reason, in a future high-frequency heating apparatus employing an inverter circuit, it is urgent that the above problems are effectively solved.

SUMMARY OF THE INVENTION

It is, therefore, an object of the present invention to provide a new and improved high-frequency heating apparatus having a digital controlled inverter circuit in which an effective switching timing detector is arranged, an arrangement can be simplified, cost can be decreased, and sufficient safety against a high-voltage fault in a main controller can be assured.

It is another object of the present invention to provide a cooker which can further simplify the arrangement.

According to one aspect of the present invention, there is provided a high-frequency heating apparatus comprising:

a high-frequency heat source for supplying a predetermined high-frequency heating output;

inverter means for receiving an AC input and supplying a high-frequency output to drive the high-frequency heat source, including means for rectifying the AC input, and a switching element for switching a DC output from the rectifying means;

timing means, coupled to the inverter means, for detecting a switching timing of the switching element in the inverter means;

control means for outputting an ON/OFF signal having a predetermined duty ratio corresponding to a heating output set value associated with the predetermined high-frequency heating output, the ON/OFF signal being output at a predetermined timing in response to a detection output from the timing means;

driving means for driving the switching element in the inverter means in response to the ON/OFF signal output from the control means;

first isolating means for electrically isolating the timing means from the control means; and second isolating means for electrically isolating the control means from the driving means.

According to another aspect of the present invention, there is provided a high-frequency heating apparatus comprising:

a heating operation section;

an inverter circuit for rectifying an AC power supply voltage and converting the rectified voltage into an AC having a predetermined frequency by a switching operation to supply the converted AC to the heating operation section;

a timing circuit for receiving the voltage of the inverter circuit to detect a switching timing of the inverter circuit;

a controller for outputting an ON/OFF signal for switching the inverter circuit in response to a detection output from the timing circuit;

a drive circuit for driving the inverter circuit in response to the ON/OFF signal output from the controller; and a first isolating circuit arranged between the timing circuit and the controller and a second isolation circuit arranged between the controller and the drive circuit.

According to still another aspect of the present invention, there is provided a high-frequency heating apparatus comprising:

a heating operation section;

an inverter circuit for rectifying an AC power supply voltage and converting the rectified voltage into an AC having a predetermined frequency by a switching operation to supply the converted AC to the heating operation section;

a timing circuit for receiving the voltage of the inverter circuit to detect a switching timing of the inverter circuit;

a controller for outputting an ON/OFF signal for switching the inverter circuit in response to a detection output from the timing circuit;

a drive circuit for driving the inverter circuit in response to the ON/OFF signal output from the controller; and a first isolation circuit arranged between the timing circuit and the controller and a second isolation circuit arranged between the controller and the drive circuit, wherein, in particular, a rectified voltage of the inverter circuit is used as an operation power supply voltage of the timing circuit.

In the above-mentioned first and second aspects, the timing circuit for detecting a switching timing is left, and the following operations until the ON/OFF signal is output are digitally processed by the controller.

In the third aspect, an exclusive power supply circuit for the timing circuit is not required.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Figure 1:
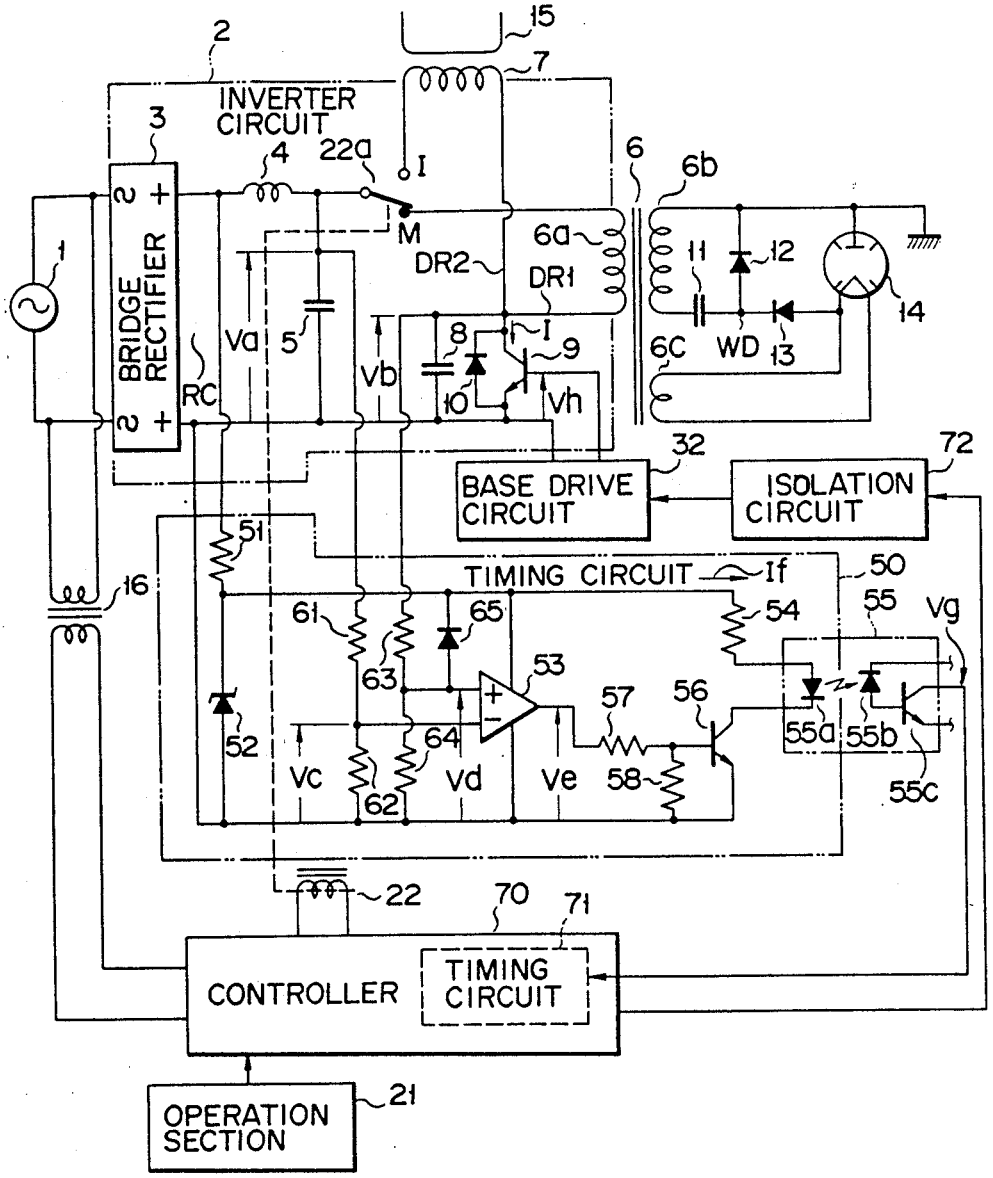
FIG. 1 is a circuit diagram showing an arrangement of a high-frequency heating apparatus according to a preferred embodiment of the present invention.

Reference will now be made in detail to the presently preferred embodiments of the invention as illustrated in the accompanying drawings, in which like reference characters designate like or corresponding parts throughout the several drawings.

Prior to a description of a preferred embodiment of the present invention, a basic example including its technical background will be described hereinafter.

Figure 3:
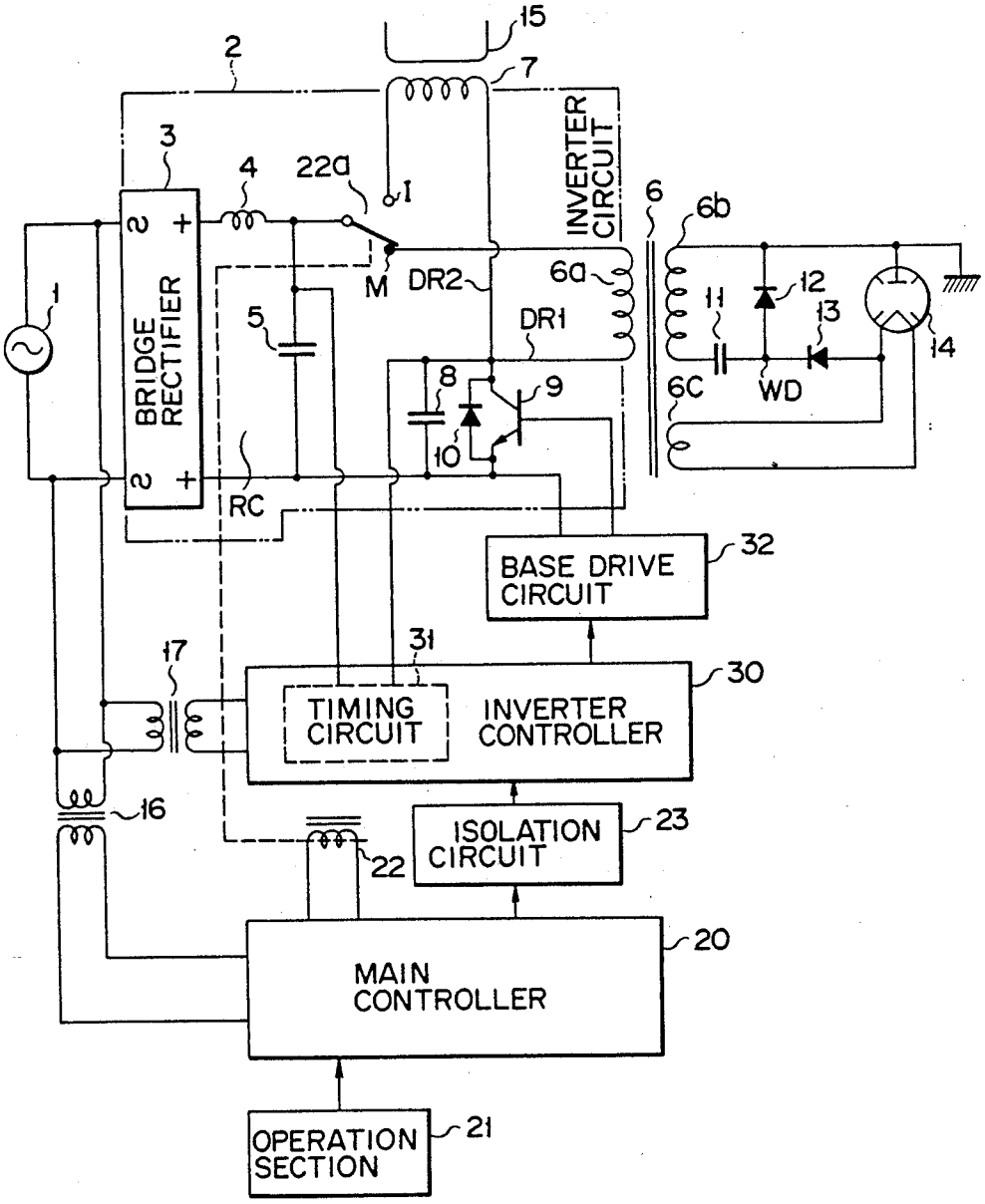
FIGS. 3 and 4 are circuit diagrams showing an arrangement of a high-frequency heating apparatus according to a basic example of the present invention.

An example of a composite cooker having the above-mentioned two heating functions is shown in FIG. 3.

Referring to FIG. 3, reference numeral 1 denotes a commercial AC power supply connected to an inverter circuit 2.

The inverter circuit 2 includes a rectification circuit (RC) having a bridge rectifier 3, a choke coil 4, and a smoothing capacitor 5. In the inverter circuit 2, the positive output terminal of the rectification circuit RC is connected to one terminal of a primary coil 6a of a high-voltage transformer 6 through a microwave range selection contact M of a relay contact 22a, and is connected to one terminal of a heating coil 7 through an induction heating cooker selection contact I.

The heating coil 7 serves as a heating operation section of the induction heating cooker.

In addition, the other terminal of the primary coil 6a and the other terminal of the heating coil 7 are connected to one terminal of a capacitor 8, and the other terminal of the capacitor 8 is connected to the negative output terminal of the rectification circuit RC. More specifically, when the range selection contact M of the relay contact 22a is closed, a series resonance circuit DR1 is formed by the primary coil 6a and the capacitor 8. When the induction heating cooker selection contact I of the relay contact 22a is closed, a series resonance circuit DR2 is formed by the heating coil 7 and the capacitor 8.

A collector-emitter path of an npn transistor 9 serving as a switching element and a damper diode 10 having a polarity shown in FIG. 3 are connected in parallel with the capacitor 8.

A secondary coil 6b of the high-voltage transformer 6 is connected to an anode-cathode path of a magnetron 14 through a half-wave voltage doubler rectification circuit WV including a high-voltage capacitor 11 and high-voltage diodes 12 and 13. The anode of the magnetron 14 is grounded, and its heated (cathode) is connected to a secondary coil 6c of the high-voltage transformer 6. In other words, the heating operation section of the microwave oven extends from the high-voltage transformer 6 to the magnetron 14.

Reference numeral 15 denotes a pan made of a magnetic material to be set on the heating operation section of the induction heating cooker by a user, as needed.

The commercial AC power supply 1 is also connected to a main controller 20 through a step-down power supply transformer 16, and is connected to an inverter controller 30 through a step-down power supply transformer 17.

The main controller 20 for controlling the entire cooker includes a microcomputer and its peripheral circuits (including a DC power supply circuit), and is externally connected to an operation section 21, a relay 22, and an isolation circuit 23. The operation section 21 sets a cooking mode, a cooking time, a heating output level, and the like.

The inverter controller 30 includes a timing circuit 31 for receiving an output voltage of the rectification circuit RC and a collector voltage of the transistor 9 in the inverter circuit 2 to detect an ON/OFF timing of the transistor 9 as a switching timing of the inverter circuit 2. The inverter controller 30 outputs an ON/OFF signal for switching the inverter circuit 2 in response to a detection output from the timing circuit 31 and an output set signal supplied from the main controller 20 through the isolation circuit 23.

The ON/OFF signal from the inverter controller 30 is supplied to a base drive circuit 32 serving as a drive circuit to cause the base drive circuit 32 to ON/OFF-drive the transistor 9.

More specifically, a microwave oven cooking mode, a desired heating output, and a heating time are set in the operation section 21. In addition, when a cooking start operation is performed, an output set signal having a level corresponding to the set heating output is output from the main controller 20, and is supplied to the inverter controller 30 through the isolation circuit 23.

The inverter controller 30 outputs an ON/OFF signal having a duty ratio corresponding to the level of the output set signal to the base drive circuit 32.

The base drive circuit 32 turns on/off the transistor 9 in the inverter circuit 2 in response to the ON/OFF signal.

When the transistor 9 is turned on/off, the resonance circuit DR1 including the primary coil 6a and the capacitor 8 is oscillated to supply a high-frequency current to the primary coil 6a. Thus, the magnetron 14 performs oscillation to start induction heating cooking using a high-frequency wave (microwave).

On the other hand, when an induction heating cooking mode is set in the operation section 21, the main controller 20 energizes the relay 22. The contact 22a is switched from the microwave range selection contact M to the induction heating cooker selection contact I to cause the heating coil 7 and the capacitor 8 to form the resonance circuit DR2. Therefore, a high-frequency magnetic field is generated from the heating coil 7, and the pan 15 is self-heated by an eddy-current loss, thus starting induction heating cooking.

Regardless of the mode set for cooking, the inverter controller 30 causes the timing circuit 31 to detect an ON/OFF timing of the transistor 9 so that a loss generated by a switching operation of the inverter circuit 2 is minimized. A generation timing of the ON/OFF signal is controlled in response to the detection output.

The isolation circuit 23 is inserted between the main controller 20 and the inverter controller 30. The isolation circuit 23 is arranged because the controller 20 mainly performs digital processing, and the inverter controller 30 serves as a so called charge section directly coupled to the inverter circuit 2. In other words, by inserting the isolation circuit 23, the controller 20 can be protected from a high voltage.

In such a cooker, since the inverter controller 30 is of digital type, e.g., an oscillation circuit for outputting a sawtooth signal and a pulse width modulation circuit for modulating the pulse width of an output from the oscillation circuit in response to an output set signal (neither are shown) are required. As a result, the drawbacks such as a complicated arrangement and high cost have not been eliminated.

The inverter controller 30, therefore, may include digital circuits, thus achieving a simple arrangement.

Figure 4:
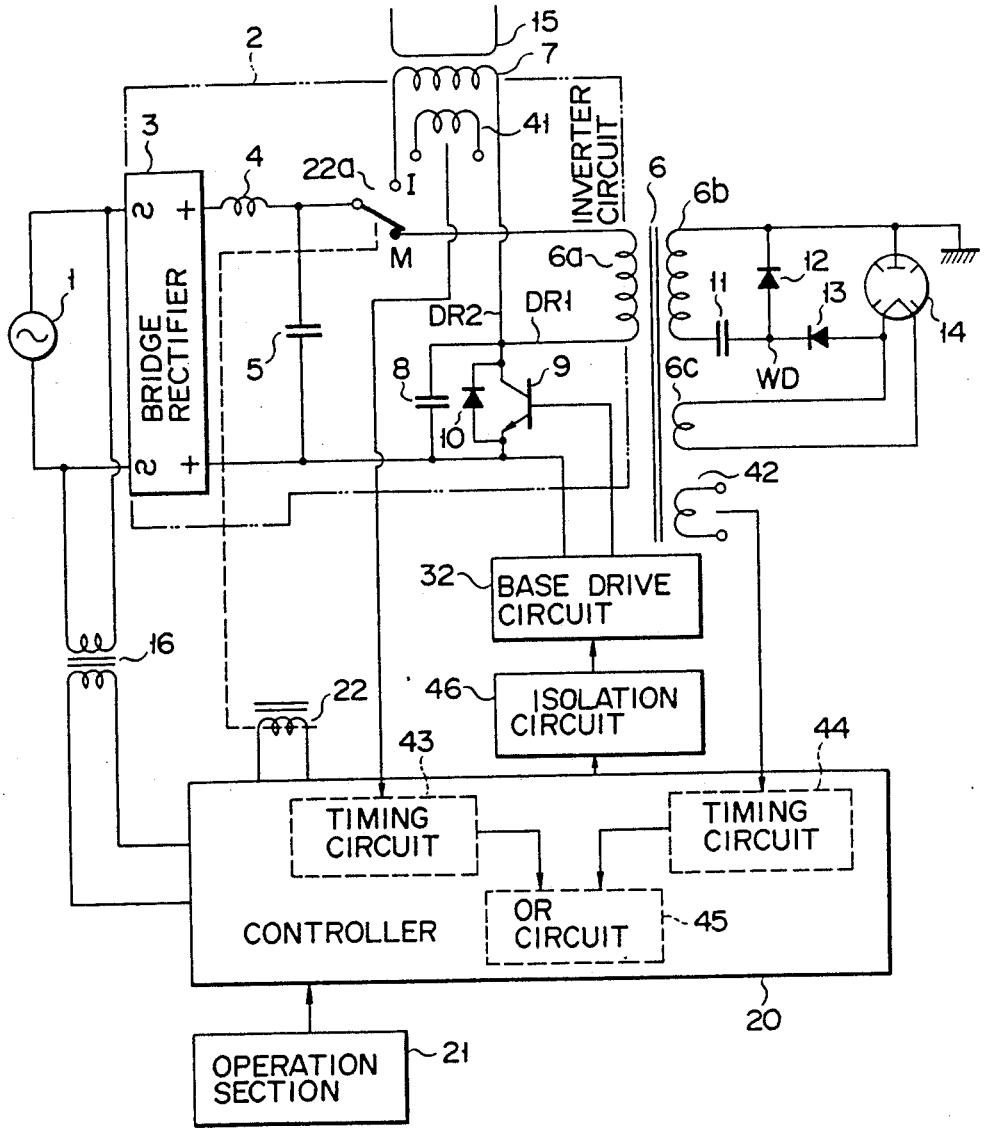

An illustrative example of the digital inverter controller 30 is shown in FIG. 4.

A timing detection coil 41 is arranged near the heating coil 7, and a timing detection coil 42 is arranged at the secondary side of the high-voltage transformer 6. Outputs from these coils are supplied to timing circuits 43 and 44 of a controller 20', respectively.

The timing circuit 43 detects an ON/OFF timing of the transistor 9 in response to an output from the coil 41 during induction heating cooking by the heating coil 7. The timing circuit 44 detects an ON/OFF timing of the transistor 9 in response to an output from the coil 42 during induction heating cooking by the magnetron 14.

The controller 20' also includes an OR circuit 45. The detection output from the timing circuit 43 or 44 is extracted by the OR circuit 45, and an ON/OFF signal is output by digital processing in response to the detection output and the output set signal.

The ON/OFF signal output from the controller 20' is supplied to the base drive circuit 32 through an isolation circuit 46. More specifically, the controller 20' can digitally function in place of the inverter controller 30 shown in FIG. 3. Therefore, a simple arrangement can be achieved as compared with an arrangement in FIG. 3.

In FIG. 4, however, since the two coils 41 and 42 are required to detect the ON/OFF timing, a simple arrangement cannot be necessarily achieved in practice in this respect.

A preferred embodiment of the present invention obtained by improving the above-mentioned basic example will be described hereinafter with reference to the accompanying drawings. More specifically, FIG. 1 shows a composite cooker according to an embodiment of the present invention. The same reference numerals in FIG. 1 denote the same parts as in FIGS. 3 and 4, and a description thereof will be omitted.

As shown in FIG. 1, a timing circuit 50 is connected to the output terminal of a bridge rectifier 3 in an inverter circuit 2.

In the timing circuit 50, a rectified voltage (pulse current) of the bridge rectifier 3 is supplied to a Zener diode 52 through a resistor 51, and that Zener diode 52 is connected to a power supply terminal of a comparator 53. The anode of a light-emitting diode 55*a* is connected to the cathode of the Zener diode 52 through a resistor 54, and the cathode of the light-emitting diode 55*a* is connected to the anode of the Zener diode 52 through a collector-emitter path of an npn transistor 56.

In addition, in the timing circuit 50, a voltage Va of a smoothing capacitor 5 in the inverter circuit 2 is applied to a series circuit consisting of resistors 61 and 62, and a collector voltage Vb of a transistor 9 in the inverter circuit 2 is applied to a series circuit consisting of resistors 63 and 64. A node of the resistors 63 and 64 is connected to the cathode of the Zener diode 52 through a diode 65.

A voltage Vc of the resistor 62 is supplied to the negative input terminal (−) of the comparator 53, and a voltage Vd of the resistor 64 is supplied to the positive input terminal (+) of the comparator 53. An output voltage Ve of the comparator 53 is applied to a resistor 58 through a resistor 57, and the voltage of the resistor 58 is applied to a base-emitter path of the transistor 56.

The light-emitting diode 55*a* constitutes a photo-coupler 55 serving as an isolation circuit together with a light-receiving diode 55*b* and an npn transistor 55*c*, and causes the transistor 55*c* to output a collector voltage Vg.

A controller 70 is connected to an AC power supply 1 through a step-down power supply transformer 16.

The controller 70 for controlling the entire cooker includes a microcomputer and its peripheral circuits. The controller 70 includes a timing circuit 71, and is externally connected to an operation section 21, a relay 22, and an isolation circuit 72.

The timing circuit 71 receives a output voltage Vg from the photo-coupler 55 to detect an ON/OFF timing of the transistor 9.

More specifically, the controller 70 outputs an ON/OFF signal for switching the inverter circuit 2 by digital processing in response to a detection output from the timing circuit 71 and a heating output set value of the operation section 21.

The ON/OFF signal from the controller 70 is supplied to a base drive circuit 32 through the isolation circuit 72 to ON/OFF-drive the transistor 9.

Figure 2:
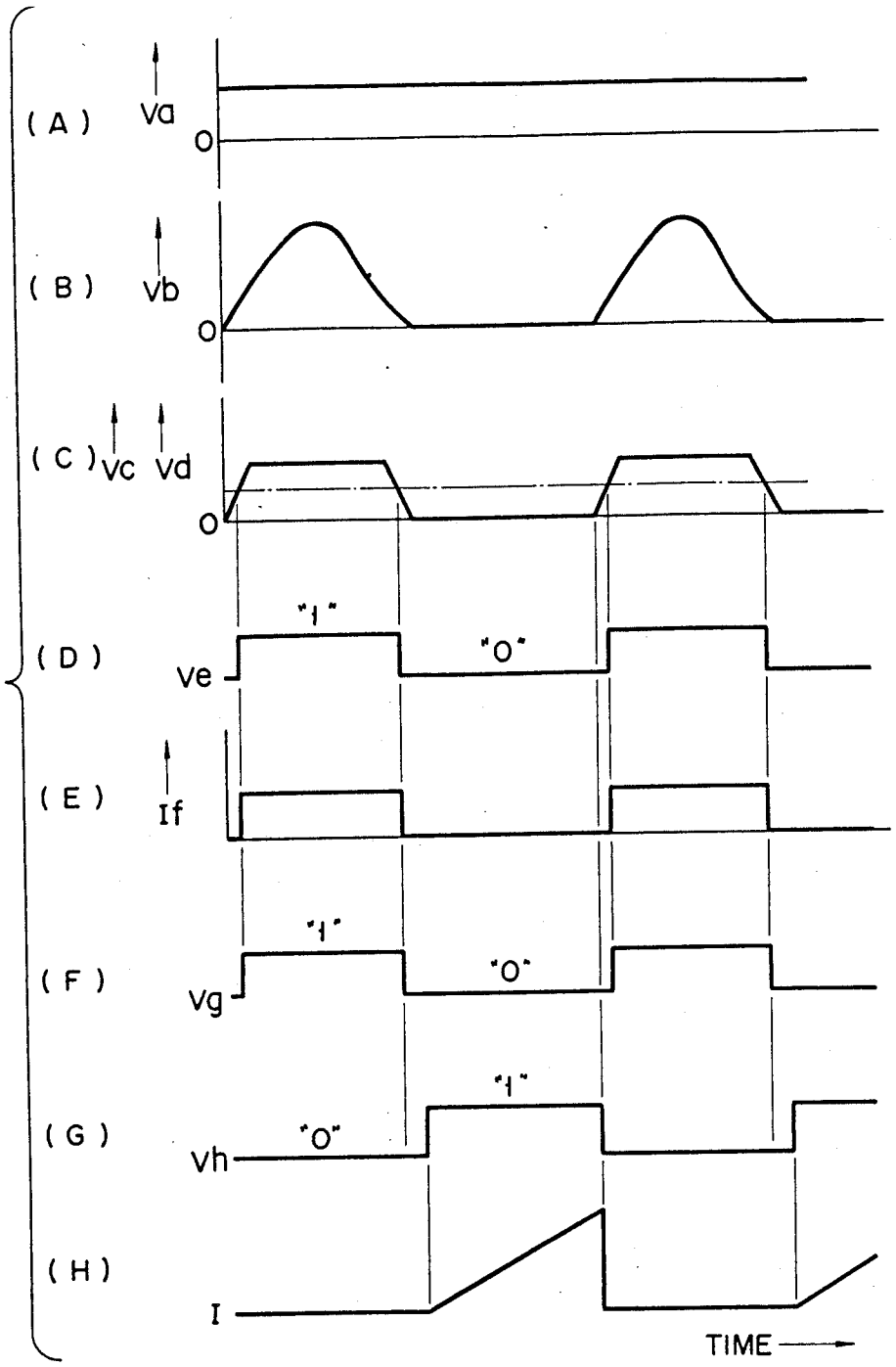
FIG. 2 is a timing chart showing waveforms of units in FIG. 1.

An operation in the above arrangement will be described below with reference to a timing chart in FIG. 2.

A microwave oven cooking mode, a desired heating output, and a heating time are set in the operation section 21, and a cooking start operation is performed. Then, the controller 70 outputs an ON/OFF signal having a duty ratio corresponding to a heating output set value.

The base drive circuit 32 receives the ON/OFF signal from the controller 70 through the isolation circuit 72 to turn on/off the transistor 9 in the inverter circuit 2 in response to the ON/OFF signal.

When the transistor 9 is turned on/off, a resonance circuit DR1 including a primary coil 6*a* and a capacitor 8 is oscillated to supply a high-frequency current to the primary coil 6*a*. Thus, a magnetron 14 performs oscillation to start induction heating cooking using a high-frequency wave.

On the other hand, when an induction heating cooking mode is set in the operation section 21, the controller 70 energizes the relay 22. A contact 22*a* is switched from a contact M to a contact I to cause a heating coil 7 and the capacitor 8 to form a resonance circuit DR2. Therefore, a high-frequency magnetic field is generated from the heating coil 7, and a pan 15 is self-heated by an eddy-current loss, thus starting induction heating cooking.

Regardless of the mode set for cooking, the timing circuit 50 stabilizes an output voltage (ripple current) of the bridge rectifier 3 by the resistor 51 and the Zener diode 52 to receive the stabilized voltage as an operation power supply voltage.

The comparator 53 in the timing circuit 50 compares a clamp voltage Vd (FIG. 2C) of the collector voltage Vb of the transistor 9 with the voltage Va (FIG. 2A) of the smoothing capacitor 5. When the voltage Vb is higher than the voltage Va, the output voltage Ve (FIG. 2D) of the comparator 53 is set at logic "1", and the transistor 56 is turned on.

When the transistor 56 is turned on, a current If (FIG. 2E) is supplied to the light-emitting diode 55*a* of the photo-coupler 55, and the light-emitting diode 55*a* emits a light beam. Then, the light-receiving diode 55*b* receives the light beam to turn off the transistor 55*c*, and a voltage Vg (FIG. 2F) is set at logic "1".

When the voltage Vd is lower than the voltage Va, the output voltage Ve (FIG. 2D) of the comparator 53 is set at logic "0", and the transistor 56 is turned off.

When the transistor 56 is turned off, the current If (FIG. 2F) is not supplied to the light-emitting diode 55*a*. The transistor 55*c* is turned on and the voltage Vg (FIG. 2F) is set at logic "0".

When the voltage Vg is set at logic "0", the controller 70 outputs an ON/OFF signal at a proper timing. When the ON/OFF signal is output, an output voltage Vh (FIG. 2G) of the base drive circuit 32 is set at logic "1" at its ON timing. Therefore, the transistor 9 is turned on, and a collector current I (FIG. 2H) flows.

More specifically, the transistor 9 is turned on when the collector voltage Vb (FIG. 2B) is lowest. Therefore, a switching loss of the transistor 9 can be minimized.

The controller 70 sets an ON period of the ON/OFF signal in accordance with a heating output set value to control the heating output.

Thus, the timing circuit 50 for detecting the switching timing of the switching element (transistor 9) in the inverter circuit 2 is left, and the following operations until the ON/OFF signal is output are digitally processed by the controller 70. Therefore, the oscillation circuit for outputting a sawtooth signal and the pulse width modulation circuit which are required in FIG. 3 are not required. In addition, neither of the two coils for detecting a timing shown in FIG. 4 are required, thus achieving a simple arrangement. Therefore, cost can be decreased.

In addition, the timing circuit 50 is arranged such that an operation power supply voltage is supplied from the inverter circuit 2. Therefore, an exclusive power supply circuit for the timing circuit 50 is not required, thus greatly simplifying the arrangement.

The photo-coupler (isolation circuit) 55 is inserted between the controller 70 and the timing circuit 50 directly coupled to the inverter circuit 2, and the isolation circuit 72 is inserted between the controller 70 and the base drive circuit 32 directly coupled to the inverter circuit 2. Therefore, the controller 70 can be protected from a high voltage, thus assuring sufficient safety.

Although the composite cooker has been described in the above embodiment, the present invention can also be applied to an independent cooker, i.e., a microwave oven or an induction heating cooker. The isolation circuit 72 can employ the same arrangement as that of the photo-coupler 55. However, when a photo-coupler 55 similarly functions to electrically insulate signal lines from each other, another arrangement can be used for the insulation circuit 72.

The present invention is not limited to the above embodiment, and various changes and modifications may be made without departing from the spirit and the scope of the present invention.

As has been described above, the high-frequency heating apparatus according to one aspect of the present invention comprises a heating operation section, an inverter circuit for rectifying an AC power supply voltage and converting the rectified voltage into an AC having a predetermined frequency by a switching operation to supply the converted AC to the heating operation section, a timing circuit for receiving the voltage of the inverter circuit to detect a switching timing of the inverter circuit, a controller for outputting an ON/OFF signal for switching the inverter circuit in response to a detection output of the timing circuit, a drive circuit for driving the inverter circuit in response to the ON/OFF signal output from the controller, a first insulation circuit arranged between the timing circuit and the controller, and a second insulation circuit arranged between the controller and the drive circuit. Therefore, according to the present invention, an arrangement can be simplified, cost can be decreased, and sufficient safety of the controller can be assured.

The high-frequency heating apparatus according to another aspect of the present invention comprises a heating operation section, an inverter circuit for rectifying an AC power supply voltage and converting the rectified voltage into an AC having a predetermined frequency by a switching operation to supply the converted AC to the heating operation section, a timing circuit for receiving the voltage of the inverter circuit to detect a switching timing of the inverter circuit, a controller for outputting an ON/OFF signal for switching the inverter circuit in response to a detection output of the timing circuit, a drive circuit for driving the inverter circuit in response to the ON/OFF signal output from the controller, an insulation circuit arranged between the timing circuit and the controller, and an insulation circuit arranged between the controller and the drive circuit. In particular, a rectified voltage of the inverter circuit is used as a operation power supply voltage of the timing circuit. Therefore, according to this aspect of the present invention, simplification of the arrangement can be further promoted.

I claim:

1. A high-frequency heating apparatus comprising:

a high-frequency heat source for supplying a predetermined high-frequency heating output;

inverter means for receiving an AC input and supplying a high-frequency output to drive said high-frequency heat source, including means for rectifying the AC input, and a switching element for switching a DC output from said rectifying means;

timing means, coupled to said inverter means, for detecting a switching timing of said switching element in said inverter means, the timing means including a means for receiving a pulse current output from said rectifying means in said inverter means to output a DC output for driving said timing means;

control means for outputting an ON/OFF signal having a predetermined duty ratio corresponding to a heating output set value associated with the predetermined high-frequency heating output, the ON/OFF signal being output at a predetermined timing in response to a detection output from said timing means;

driving means for driving said switching element in said inverter means in response to the ON/OFF signal output from said control means;

first isolating means for electrically isolating said timing means from said control means; and second isolating means for electrically isolating said control means from said driving means.

2. An apparatus according to claim 1, wherein said timing means includes means for comparing the DC output from said rectifying means in said inverter means with a voltage to be applied to said switching element.

3. An apparatus according to claim 2, wherein said timing means includes means for receiving and clamping a voltage to be applied to said switching element, and said comparing means compares the voltage clamped by said clamping means with the DC output from said rectifying means to output logic "1" or "0".

4. An apparatus according to claim 3, wherein said timing means includes an element to be turned or/off in response to an output from said comparing means.

5. An apparatus according to claim 1, wherein said first isolating means includes a photo-coupler having light-emitting and light-receiving elements.

6. An apparatus according to claim 1, wherein said control means includes means for controlling a timing to turn on said switching element in response to a detection output from said timing means when the voltage to be applied to said switching element in said inverter means is lowest.

7. An apparatus according to claim 1, wherein said high-frequency heat source includes a magnetron.

8. An apparatus according to claim 7, wherein said magnetron is coupled to said inverter means through a high-voltage transformer and a rectification circuit.

9. An apparatus according to claim 1, wherein said high-frequency heat source includes a heating coil for performing electromagnetic induction heating.

10. A high-frequency heating apparatus comprising:

a heating operation section;

an inverter circuit for rectifying the AC power supply voltage and converting the rectified voltage into an AC having a predetermined frequency by a switching operation to supply the converted AC to said heating operation section;

a timing circuit for receiving the voltage of said inverter circuit to detect a switching timing of said inverter circuit, the timing circuit being powered from the rectified voltage of said inverter circuit;

a controller for outputting an ON/OFF signal for switching said inverter circuit in response to a detection output from said timing circuit;

a drive circuit for driving said inverter circuit in response to the ON/OFF signal output from said controller; and a first isolation circuit arranged between said timing circuit and said controller and a second isolation circuit arranged between said controller and said drive circuit.

11. A high-frequency heating apparatus comprising:

microwave heating means for generating a first heating power by microwave heating;

induction heating means for generating a second heating power by induction heating;

inverter means for receiving an AC input and supplying a high-frequency output to selectively drive said microwave heating means or said induction heating means, inducing rectifying means for rectifying the AC input, and a switching element for switching a DC output from said rectifying means;

timing means, coupled to said inverter means, for detecting a switching timing of said switching element in said inverter means, the timing means including a means for receiving a pulse current output from said rectifying means in said inverter means to output a DC output for driving said timing means;

control means for outputting an ON/OFF signal having a predetermined duty ratio corresponding to a heating output set value associated with the first or second heating power, the ON/OFF signal being output at a predetermined timing in response to a detection output from said timing means;

driving means for driving said switching element in said inverter means in response to the ON/OFF signal output from said control means;

first isolating means for electrically isolating said timing means from said control means; and second isolating means for electrically isolating said control means from said driving means.

12. An apparatus according to claim 11, wherein said timing means includes means for comparing the DC output from said rectifying means in said inverter means with a voltage to be applied to said switching element.

13. An apparatus according to claim 12, wherein said timing means includes means for receiving and clamping a voltage to be applied to said switching element, and said comparing means compares the voltage clamped by said clamping means with the DC output from said rectifying means to output logic "1" or "0".

14. An apparatus according to claim 13, wherein said timing means includes an element to be turned on/off in response to an output from said comparing means.

15. An apparatus according to claim 11, wherein said first isolating means consists of a photo-coupler having light-emitting and light-receiving elements.

16. An apparatus according to claim 11, wherein said control means includes means for controlling a timing to turn on said switching element in response to a detection output from said timing means when the voltage to be applied to said switching element in said inverter means is lowest.

17. An apparatus according to claim 11, wherein said inverter means includes switching means for selectively coupling said microwave heating means or said induction heating means, and said control means includes means for energizing said switching means in said inverter means in accordance with a microwave heating mode or an induction heating mode.

* * * * *